US010038947B2

(12) United States Patent
Kim et al.

(10) Patent No.: US 10,038,947 B2
(45) Date of Patent: Jul. 31, 2018

(54) METHOD AND APPARATUS FOR OUTPUTTING SOUND THROUGH SPEAKER

(71) Applicant: SAMSUNG ELECTRONICS CO., LTD., Suwon-si (KR)

(72) Inventors: Jong-bae Kim, Seoul (KR); Dae-joung Kim, Seoul (KR); Dong-kyu Park, Hwaseong-si (KR); Sung-ha Son, Suwon-si (KR); Gyeong-tae Lee, Seoul (KR); Joo-yeon Lee, Seoul (KR); Jong-in Jo, Suwon-si (KR); Sung-joo Kim, Suwon-si (KR); Dong-hyun Jung, Seoul (KR); Seon-ho Hwang, Yongin-si (KR); Dae-kyung Ahn, Namyangju-si (KR); Sang-sung Woo, Seoul (KR); Sang-min Hyun, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 85 days.

(21) Appl. No.: 14/523,146

(22) Filed: Oct. 24, 2014

(65) Prior Publication Data

US 2015/0117686 A1 Apr. 30, 2015

Related U.S. Application Data

(60) Provisional application No. 61/895,103, filed on Oct. 24, 2013.

(30) Foreign Application Priority Data

Feb. 20, 2014 (KR) ..... 10-2014-0019433

(51) Int. Cl.
*H04R 25/00* (2006.01)
*H04R 1/02* (2006.01)
(Continued)

(52) U.S. Cl.
CPC ..... *H04R 1/028* (2013.01); *H04R 1/26* (2013.01); *H04R 1/403* (2013.01); *H04R 3/12* (2013.01);
(Continued)

(58) Field of Classification Search
CPC ..... H04R 1/028; H04R 1/26; H04R 1/403; H04R 2499/11; H04R 2499/15; H04R 3/12; H04R 5/02; H04R 7/045; H04S 7/303
(Continued)

(56) References Cited

U.S. PATENT DOCUMENTS 8,447,052 B2 5/2013 Lee et al.
8,494,186 B2 7/2013 Lee et al.
(Continued)

FOREIGN PATENT DOCUMENTS

EP 2360938 A1 8/2011
JP 2012-244314 A 12/2012
(Continued)

OTHER PUBLICATIONS

Communication, Issued by the International Searching Authority, dated Jan. 27, 2015, in counterpart International Application No. PCT/KR2014/010058.
(Continued)

*Primary Examiner* — Vivian Chin
*Assistant Examiner* — Friedrich W Fahnert
(74) *Attorney, Agent, or Firm* — Sughrue Muon, PLLC

(57) ABSTRACT

An apparatus including a first speaker configured to output higher-frequency sound from among sound of a channel via at least one slit, and a second speaker configured to output lower-frequency sound from among the sound of the chan-
(Continued)

nel via at least one other slit. The at least one slit may have a thickness that is less than a wavelength of sound emitted.

17 Claims, 11 Drawing Sheets

(51) Int. Cl.

| | |
|---|---|
| ***H04R 1/26*** | (2006.01) |
| ***H04R 1/40*** | (2006.01) |
| *H04R 5/02* | (2006.01) |
| *H04R 3/12* | (2006.01) |
| *H04R 7/04* | (2006.01) |
| *H04S 7/00* | (2006.01) |

(52) U.S. Cl.
CPC ..... *H04R 5/02* (2013.01); *H04R 7/045* (2013.01); *H04R 2499/11* (2013.01); *H04R 2499/15* (2013.01); *H04S 7/303* (2013.01)

(58) Field of Classification Search
USPC ..... 381/152, 333, 337–339, 388, 347, 391; 455/350, 347; 379/433.02
See application file for complete search history.

(56) References Cited

U.S. PATENT DOCUMENTS

| | | | | |
|---|---|---|---|---|
| 8,818,006 | B2 | 8/2014 | Yamauchi et al. | |
| 8,953,824 | B2 | 2/2015 | Park | |
| 9,462,213 | B2 * | 10/2016 | Yamauchi | H04N 5/642 |
| 2004/0190727 | A1 * | 9/2004 | Bacon | H04S 3/002 381/61 |
| 2006/0046797 | A1 * | 3/2006 | Chen | H04M 1/0237 455/575.4 |
| 2008/0063225 | A1 | 3/2008 | Choi | |
| 2009/0129623 | A1 * | 5/2009 | Weckstrom | H04R 1/2842 381/386 |
| 2009/0285438 | A1 | 11/2009 | Liou et al. | |
| 2010/0067726 | A1 * | 3/2010 | Suzuki | G06F 1/1605 381/333 |
| 2011/0002487 | A1 * | 1/2011 | Panther | H04R 5/04 381/300 |
| 2011/0044489 | A1 * | 2/2011 | Saiki | H04R 7/20 381/388 |
| 2011/0188678 | A1 | 8/2011 | Lee et al. | |
| 2011/0188679 | A1 | 8/2011 | Lee et al. | |
| 2011/0205694 | A1 * | 8/2011 | Ejima | H04M 1/0237 361/679.01 |
| 2012/0052925 | A1 * | 3/2012 | Ku | H04M 1/605 455/569.1 |
| 2012/0093348 | A1 | 4/2012 | Li | |
| 2012/0188371 | A1 | 7/2012 | Chen et al. | |
| 2013/0121515 | A1 | 5/2013 | Hooley et al. | |
| 2013/0129122 | A1 * | 5/2013 | Johnson | H04R 3/12 381/306 |
| 2013/0279730 | A1 * | 10/2013 | Tanaka | H04R 1/021 381/333 |
| 2014/0064549 | A1 * | 3/2014 | Liang | H04R 1/323 381/387 |
| 2014/0119580 | A1 * | 5/2014 | Osada | H04S 7/303 381/300 |
| 2014/0226837 | A1 * | 8/2014 | Grokop | H04M 1/6016 381/103 |
| 2014/0239781 | A1 * | 8/2014 | Allore | B29C 45/14311 312/223.1 |
| 2015/0189178 | A1 * | 7/2015 | Lombardi | H04N 5/2258 348/207.99 |
| 2015/0195631 | A1 * | 7/2015 | Forrester | H04M 1/03 381/345 |
| 2015/0281410 | A1 * | 10/2015 | Takahashi | H04M 1/02 455/575.1 |
| 2016/0192063 | A1 * | 6/2016 | Lee | H04N 5/642 381/306 |

FOREIGN PATENT DOCUMENTS

| | | | |
|---|---|---|---|
| KR | 10-2009-0100566 | A | 9/2009 |
| KR | 10-2011-0090062 | A | 8/2011 |
| KR | 10-2011-0090063 | A | 8/2011 |
| KR | 10-2012-0103046 | A | 9/2012 |

OTHER PUBLICATIONS

Communication dated May 18, 2017 issued by the European Patent Office in counterpart European Patent Application No. 14855027.0.
Communication dated Oct. 2, 2017 by the European Patent Office in counterpart European Patent Application No. 14855027.0.

* cited by examiner

METHOD AND APPARATUS FOR OUTPUTTING SOUND THROUGH SPEAKER

CROSS-REFERENCE TO RELATED APPLICATION(S)

This application claims priority from Korean Patent Application No. 10-2014-0019433, filed on Feb. 20, 2014 in the Korean Intellectual Property Office, and U.S. Provisional Application No. 61/895,103, filed on Oct. 24, 2013 in the U.S. Patent and Trademark Office, the entire disclosures of which are incorporated herein by reference.

BACKGROUND

1. Field

Apparatuses and methods consistent with exemplary embodiments relate to a method and apparatus for outputting sound through a speaker.

2. Description of Related Art

With advances in flat panel display technology, electronic devices such as digital televisions (TVs), computers, tablets, and the like are becoming slimmer. Accordingly, audio devices included in the flat panel displays should have a structure that is appropriate for slim electronic devices. For example, audio devices are recently including a down-firing front speaker and a back-firing woofer that may be installed in a thin digital TV. The down-firing front speaker is installed at a lower bezel of the digital TV so that it can emit middle-pitched sound or high-pitched sound downward. The back-firing woofer is installed on a rear surface of a digital TV so that it can emit low-pitched sound backward. The low-pitched sound that is emitted backwards diffracts to a front surface of the digital TV. However, as electronic devices are becoming ultra thin, the quality of sound is increasingly becoming degraded.

For example, because middle-pitched sound and high-pitched sound have high directivity, a sweet spot thereof is narrowly formed. Accordingly, there is a need to develop a method of outputting middle-pitched sound and high-pitched sound to have a wider sweet spot.

SUMMARY

Exemplary embodiments overcome the above disadvantages and other disadvantages not described above. Also, an exemplary embodiment is not required to overcome the disadvantages described above, and an exemplary embodiment may not overcome any of the problems described above.

One or more exemplary embodiments provide a method and apparatus for outputting sound through a speaker, and more particularly, a method of outputting middle and high-pitched sounds that have a high directivity through a speaker in order to form a wider and expanded sweet spot. The sweet spot may be used to describe the focal point between two speakers, where an individual is fully capable of hearing the stereo audio mix the way it was intended to be heard by the mixer, but is not limited thereto.

According to an aspect of an exemplary embodiment, there is provided an apparatus including a first speaker configured to output higher-frequency sound from among sound of a channel via at least one slit, and a second speaker configured to output lower-frequency sound from among the sound of the channel via at least one other slit.

Each slit may have a thickness that is less than the wavelength of sound emitted.

The first and second speakers may output sound of different channels, respectively, according to each location of the first and second speakers.

The apparatus may further include a sensor configured to sense a position of a user. The first and second speaker may output sound by being moved according to the sensed position of the user, or the apparatus may output sound via a slit that is adjacent to the sensed position of the user.

The apparatus may further include a display configured to display an image. The first and second speakers may be configured to output sound related to the displayed image.

The apparatus may further include a flat panel speaker configured to output sound at a location on the image displayed on the display at which the sound is generated using bending waves.

The flat panel speaker may be configured to output a haptic effect using the bending waves.

The apparatus may further include at least two plates that are configured to slide in a vertical direction. The first speaker may be located at an upper portion of a slit between the plates that slide in the vertical direction, and the second speaker may be located at a lower portion of the slit between the plates that slide in the vertical direction.

The apparatus may further include a flat panel speaker configured to output the higher-frequency sound using bending waves. The first or second speaker may be configured to output the lower-frequency sound.

The first and second speakers may be located along a horizontal direction or a vertical direction with respect to an upper and lower portion of the speaker apparatus, according to a size or shape of the display.

The first and second speakers may be located along a vertical direction with respect to an upper and lower ends of the apparatus, and the display may be a curved display.

The first and second speakers may be arranged in at least two directions to maximize a distance between the first and second speakers, according to a size or shape of the display.

According to an aspect of another exemplary embodiment, there is provided a method of outputting sound via a speaker, the method including determining whether a first speaker and a second speaker which each output sound via at least one slit are disposed on the same plane; obtaining forward sound or backward sound from a sound signal to be output in response to the first speaker and the second speaker being disposed on the same plane; and outputting the forward sound or the backward sound through the first speaker and the second speaker. The first speaker outputs higher-frequency sound from among sound of a channel via at least one slit, and the second speaker outputs lower-frequency sound from among the sound of the channel via at least one other slit.

The method may further include outputting the higher-frequency sound from among high-pitched sound via an upper speaker in response to the first speaker and the second speaker being disposed on different horizontal planes; and outputting the lower-frequency sound from among the high-pitched sound via a lower speaker from among the first and second speakers.

BRIEF DESCRIPTION OF THE DRAWINGS

These and/or other aspects will become apparent and more readily appreciated from the following description of exemplary embodiments, taken in conjunction with the accompanying drawings in which.

DETAILED DESCRIPTION

Figure 1:
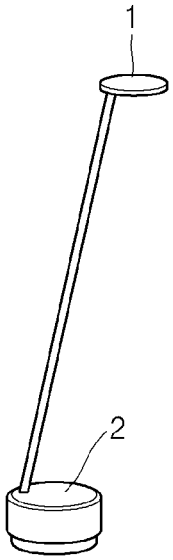
FIG. 1 is a diagram illustrating an example of a speaker apparatus according to an exemplary embodiment.

Reference will now be made to the exemplary embodiments, examples of which are illustrated in the accompanying drawings, wherein like reference numerals refer to like elements throughout. In this regard, the exemplary embodiments may have different forms and should not be construed as being limited to the descriptions set forth herein. Accordingly, the exemplary embodiments are merely described below, by referring to the figures, to explain aspects of the present description.

In the following disclosure and the accompanying drawings, well-known functions or constructions are not described or illustrated in detail if it is determined that they would obscure the description due to unnecessary detail.

The terms or expressions used herein and the claims should not be construed as being limited to those generally understood or defined in commonly used dictionaries, and should be understood according to the technical idea of the invention, based on the principle that the inventor(s) of the application can appropriately define the terms or expressions to optimally explain the invention. Thus, the exemplary embodiments set forth herein and the drawings are just exemplary embodiments of the present invention and do not completely represent the technical idea of the present invention. Accordingly, it would be obvious to those of ordinary skill in the art that the above exemplary embodiments cover all modifications, equivalents, and alternatives falling within the scope of the invention at the filing date of the present application.

It will be understood that the terms "comprises" and/or "comprising" when used in this specification, specify the presence of stated features, integers, steps, operations, elements, and/or components, but they do not preclude the presence or addition of one or more other features, integers, steps, operations, elements, components, and/or groups thereof. Also, the terms "unit", "module", and the like, correspond to units for processing at least one function or operation and may be embodied as hardware, software, or a combination thereof.

As used herein, expressions such as "at least one of," when preceding a list of elements, modify the entire list of elements and do not modify the individual elements of the list.

FIG. 1 is a diagram illustrating an example of a speaker apparatus according to an exemplary embodiment.

Referring to FIG. 1, the speaker apparatus includes a first speaker 1 and a second speaker 2.

The first speaker 1 and the second speaker 2 output sound according to a sound signal that is received from the outside, and may be slit-firing speaker systems which emit sound via a plurality of slits.

A plurality of slits may be formed in a side surface of each of the first speaker 1 and the second speaker 2 to emit sound.

The plurality of slits may be designed to each have a thickness that is less than the wavelength of sound emitted therefrom so that they may act as the origin from which the sound is emitted. As a non-limiting example, the thickness of each of the plurality of slits may be less than or equal to ¼ of 17 mms which is the wavelength of a threshold audible frequency. Also, the thicknesses of the first speaker 1 and the second speaker 2 may be designed to be sufficiently thin to reduce or prevent a degree to which the emitted sound is reflected at a side surface of the first speaker 1 or the second speaker 2. For example, the first speaker 1 and the second speaker 2 may have a thickness of 20 mm or less. Also, the plurality of slits may satisfy a ground plane radiation condition.

For example, when the first speaker 1 is on a wall surface and the second speaker is on a bottom surface, the first speaker 1 and the second speaker 2 may satisfy the ground plane radiation condition such that sound may be emitted upward from the wall surface or the bottom surface at a solid angle of $2\pi$. In this example, the wall surface may be the ground because the first speaker 1 may emit sound in a forward direction from the wall surface, and the bottom surface may be the ground because the second speaker 2 may emit sound upward from the bottom surface. Because the first speaker 1 and the second speaker 2 perform ground plane radiation, the output sound may be prevented from being reflected backward, thereby securing the quality of sound equivalent to that of sound emitted from a front-firing speaker.

Furthermore, because a speaker according to an exemplary embodiment satisfies the ground plane radiation condition, an acoustic axis thereof may be formed in an upward direction or a forward direction and an optimum sweet spot or sound area may be formed on a central or front surface in terms of vertical directivity. Also, a wide sweet spot may be formed in a forward direction because the ground plane radiation condition is satisfied in terms of horizontal directivity. The sweet spot should be understood as a sound zone, a sound area, and the like.

The first speaker 1 and the second speaker 2 according to an exemplary embodiment may be vertically spaced apart from each other by a predetermined distance and are thus capable of outputting sound of different channels. In this example, the first speaker 1 may output sound having directivity and an elevation effect and the second speaker 2 may output sound having no elevation effect. In the following disclosure, sound that has the elevation effect may cause a listener to experience a sense of localization and stereo imaging referred to as high-pitched sound. The high-pitched sound may be included in a high-altitude channel to be signaled.

Directivity refers to a form in which sound spreads from a sound source. High-directivity sound may not spread and may be straightly propagated in one direction. Thus, a sweet spot for high-directivity sound is generally narrow.

However, according to various exemplary embodiments, a speaker has a thickness that is less than the wavelength of sound emitted therefrom and a sweet spot may be formed in front of the display to be as wide as the sound emitted from the origin. Thus, when even high-directivity sound is output from the speaker including a plurality of slits, a wide sweet spot may be formed.

The higher the frequency of sound, the higher the directivity of the sound. Thus, sound of a high-directivity frequency domain among high-pitched sound may be output from the first speaker 1 that is an upper speaker. By emitting the sound of the high-directivity frequency domain from the upper speaker, a listener may sense an elevation effect. Also, sound of a low-directional frequency domain among the high-pitched sound that has low directivity and the degree of localization or stereo imaging that a listener may sense may be low, although the sound is emitted from the upper speaker. Thus, the sound of the low-directional frequency domain may be output from the second speaker 2 which is a lower speaker.

The first speaker 1 that is an upper speaker may form an upper layer for outputting high-pitched sound of high frequency, and the second speaker 2 that is a lower speaker may form a lower layer for outputting sound of a horizontal-plane channel or high-pitched sound of low frequency. The upper layer and the lower layer are referred to as sweet spots that may be formed by the first and second speakers 1 and 2, respectively.

In this case, the high-altitude channel is a channel for outputting a sound signal via a speaker that is in front of and/or above a listener's head so that the listener may sense elevation. The horizontal-plane channel may be understood as a channel for outputting a sound signal via a speaker located on a plane that is level with the listener. Sound that is not high-pitched may be included in the horizontal-plane channel but is not limited thereto and may be sound output below the plane.

High-pitched sound may be output from the upper layer and may be reflected from a ceiling and then directed to a listener. Thus, a listener of sound output from the speakers 1 and 2 may get a sense of elevation, localization, stereo imaging, and the like.

Although FIG. 1 illustrates only the first and second speakers 1 and 2 that form the upper and lower layers, respectively, exemplary embodiments are not limited thereto and the speaker apparatus may include speakers that form an upper layer and a lower layer at both sides thereof, respectively. For example, a left speaker may output sound of a left channel and a right speaker may output sound of a right channel. However, exemplary embodiments are not limited to two speakers and the speaker apparatus may include more than two speakers.

Methods and apparatuses for outputting sound through a speaker that has a thickness that is less than the wavelength of sound emitted therefrom are designed so that a sweet spot may be formed in front thereof to be as wide as the sound emitted from the origin of the display according to exemplary embodiments are described below.

Figure 2:
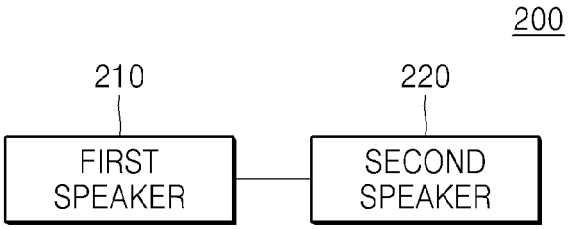
FIGS. 2 and 3 are block diagrams illustrating speaker apparatuses according to exemplary embodiments.
Figure 3:
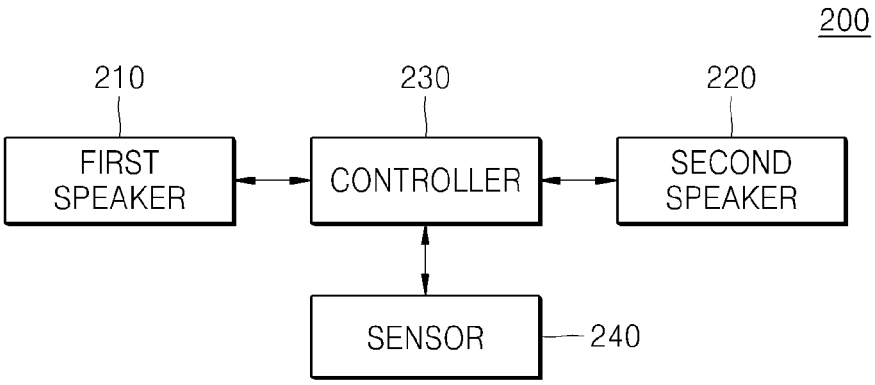

FIGS. 2 and 3 are block diagrams illustrating the speaker apparatuses according to exemplary embodiments.

Referring to FIG. 2, speaker apparatus 200 includes a first speaker 210 and a second speaker 220. However, all of these components of the speaker apparatus 200 are not dispensable components. For example, the speaker apparatus 200 may further include other components or may not include one or more of the components illustrated in FIG. 2.

The first speaker 210 may output high-frequency sound of high directivity from among high-pitched sound via at least one slit. High-directivity sound has a property of moving straight and can create a narrow sweet spot. However, when sound is output through the first speaker 210, a wide sweet spot may be formed for even high-directivity sound. In this example, high-pitched sound output through an upper layer of the first speaker 210 may be directed to a listener at an overhead position. Thus, the high-pitched sound may be distinguishable from sound output through a lower layer and the listener may experience a stereoscopic effect, a sense of localization, stereo imaging, and the like.

The second speaker 220 may output low-frequency sound that has a low directivity from among the high-pitched sound or other sound except for the high-pitched sound, via at least one slit.

The first speaker 210 and the second speaker 220 are not limited to forming upper and lower layers to output sound downward and upward and may output sound in various other directions. For example, the first speaker 210 and the second speaker 220 may be arranged in left and right directions or front and rear directions and output sound such that a listener may experience stereoscopic sound.

Furthermore, although the speaker apparatuses 200 illustrated in FIGS. 2 and 3 include the first speaker 210 and the second speaker 220, the speaker apparatuses 200 are not limited to two speakers and may include more than two speakers to output sound that has different directionalities.

Referring to FIG. 3, speaker apparatus 200 includes a first speaker 210, a second speaker 220, a controller 230, and a sensor 240. The first speaker 210 and the second speaker 220 of FIG. 3 correspond to the first speaker 210 and the second speaker 220 of FIG. 2 and thus will not be redundantly described.

However, these components are not indispensable components. For example, the speaker apparatus 200 may further include other components or may not include one or more of the components illustrated in FIG. 3.

In general, the controller 230 may control the overall operations of the speaker apparatus 200. For example, the controller 230 may control a sound signal that is received from an outside source or a sound signal stored in a memory (not shown) of the speaker apparatus 200 to be output via the first or second speaker 210 or 220. The controller 230 may control the speaker apparatus 200 under control of a user based on a control signal received from the outside source.

The sensor 240 may sense a position of the speaker apparatus 200, a position of a user, and the like, and generate a sensing signal for controlling an operation of the speaker apparatus 200. The controller 230 may control the speaker apparatus 200 according to the sensing signal generated by the sensor 240. For example, the sensor 240 may include at least one of a gyrosensor, an infrared sensor, and the like.

The gyrosensor is capable of sensing rotational inertia and may measure angular velocity based on the motion of the speaker apparatus 200. According to an exemplary embodiment, the gyrosensor may determine whether the speaker apparatus 200 is disposed on a horizontal plane or a vertical plane. The speaker apparatus 200 may control the sound signal to be output via the first or second speaker 210 or 220 according to a result of the determining. An example of a method of outputting sound through the speaker apparatus 200 according to the sensed position is described with reference to FIG. 8.

The infrared sensor is capable of sensing a human body or an animal by sensing infrared rays emitted from the human body or the animal. The speaker apparatus 200 may sense a listener using the infrared sensor and control the speaker apparatus 200 according to the position of the sensed listener. An example of a method of outputting sound from the speaker apparatus 200 according to the position of the listener is described with reference to FIG. 9.

Figure 4:
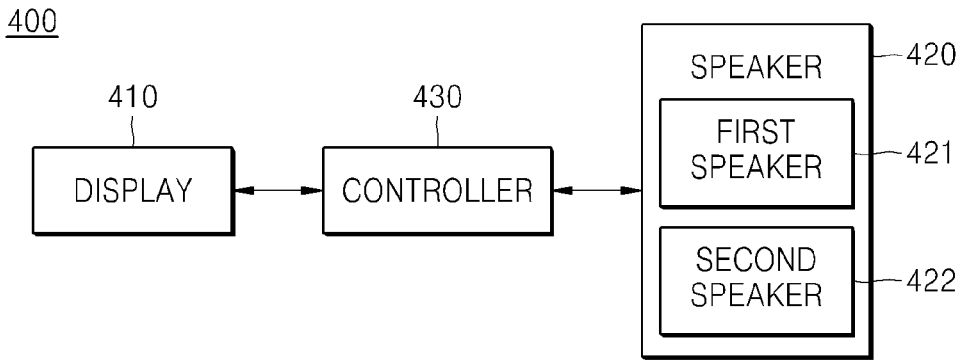
FIGS. 4 and 5 are block diagrams illustrating terminal apparatuses including speakers according to exemplary embodiments.
Figure 5:
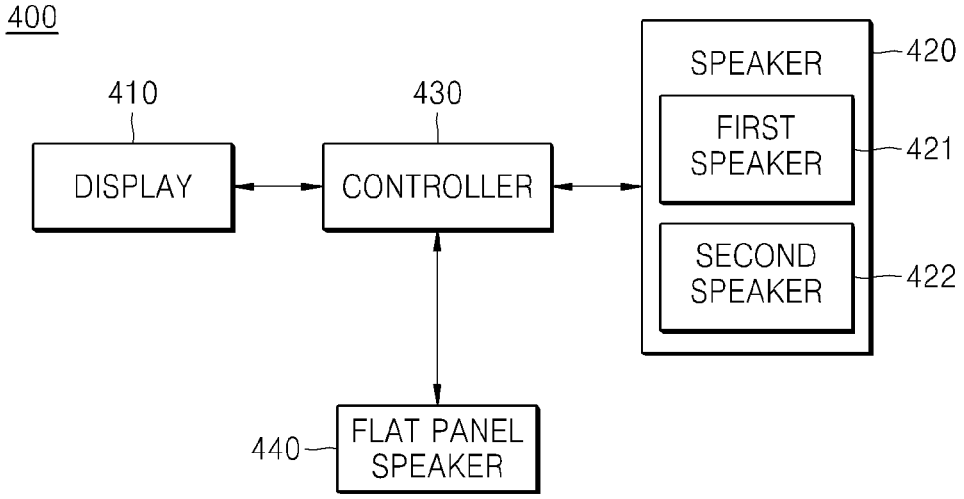

FIGS. 4 and 5 are block diagrams illustrating terminal apparatuses including a speaker according to exemplary embodiments.

Terminal apparatuses 400 illustrated in FIGS. 4 and 5 may include various types of devices. For example, the terminal apparatus 400 may include a personal computer (PC), a notebook computer, a mobile phone, a tablet PC, a navigation terminal, a smartphone, a personal digital assistant (PDA), a portable multimedia player (PMP), a digital broadcasting receiver, a tablet, an appliance, and the like. However, the types of devices are just examples and may be understood as including all devices that have been developed and placed on the market or that will be developed in the future.

Referring to FIG. 4, the terminal apparatus 400 includes a display 410, the speaker 420, and a controller 430. A first speaker 421 and a second speaker 422 of FIG. 4 correspond to the first speaker 210 and the second speaker 220 of FIG. 2 or 3. However, the components of the terminal apparatus 400 illustrated in FIG. 4 are not indispensable components. The terminal apparatus 400 may further include other components or may not include one or more of the components of the terminal apparatus 400 illustrated in FIG. 4.

The display 410 may display information or an image processed by the terminal apparatus 400. For example, the display 410 may display a user interface (UI) or a graphical user interface (GUI) that is related to usage information of the terminal apparatus 400 of a user. For example, the display 410 may display an image or a UI, and sound corresponding to the displayed image or UI may be output through the speaker 420.

The display 410 may include at least one of a liquid crystal display (LCD), a thin-film transistor (TFT)-LCD, an organic light-emitting diode (OLED), a flexible display, and a three-dimensional (3D) display. Also, two or more displays 410 may be installed in the terminal apparatus 400.

The speaker 420 may output sound according to a control signal of the controller 430. For example, the speaker 420 may output sound corresponding to the image or the UI that is being displayed on the display 410. Also, the speaker 420 may output high-directivity sound in a wide sweet spot. Thus, a listener may experience stereoscopic sound in a wide sweet spot using the speaker 420.

In general, the controller 430 may control the overall operations of the terminal apparatus 400. For example, the controller 430 may control the display 410 to display an image or control the speaker 420 to output sound corresponding to an image that is being displayed on the display 410.

According to exemplary embodiments, the controller 430 may determine a speaker from the speaker 420 for outputting sound based on whether the sound that is to be output is high-pitched sound or high-directivity sound, and control the speaker 420 to output the sound. Also, the controller 420 may control a speaker (e.g., the speaker 420) corresponding to a channel of a sound signal to output sound. For example, sound may be output through each speaker corresponding to each channel, for example, a central channel, a front channel, a rear channel, a left channel, a right channel, a high-altitude channel, and the like.

Referring to FIG. 5, the terminal apparatus 400 includes a display 410, a speaker 420, a controller 430, and a flat panel speaker 440. The display 410, the speaker 420, the first speaker 421, the second speaker 422, and the controller 430 of FIG. 5 correspond to the display 410, the speaker 420, the first speaker 421, the second speaker 422, and the controller 430 of FIG. 4 and thus will not be redundantly described here.

The flat panel speaker 440 is a thin panel type speaker. For example, when the flat panel speaker 400 is a transparent flat panel speaker, the flat panel speaker 440 may be installed in the display 410 (such as an LCD, an organic electroluminescent (EL) display, a PDP, or the like) through which a user may visually check information, thereby saving a speaker installation space. For example, the flat panel speaker 440 may be attached onto the display 410 and may vibrate under control of the controller 430 to output sound at a predetermined location on the display 410. The flat panel speaker 440 may generate sound by generating a bending wave. The flat panel speaker 440 is an example of a flat-panel sound output device. Here, 'flat panel' is a relative term and may not refer to a perfect flat surface.

The flat panel speaker 440 may include a vibration panel and a vibration unit. The vibration panel may be a flat plate that is mounted on the display 410, and may include an acryl, glass, a plastic plate, and the like, which is generally used to protect the display 410.

An exciter of the vibration unit of the flat panel speaker 440 is attached to a side of the vibration panel, and delivers vibration to vibrate the vibration panel according to a control signal of the controller 430. A device that may be used as the vibration unit of the flat panel speaker 440 is, however, not limited to the exciter, and may be any of various types of devices capable of vibrating the vibration panel.

Examples of a speaker apparatus or a terminal apparatus according to various embodiments that have a thickness less than the wavelength of sound emitted therefrom and that is thus capable of forming a sweet spot in front to be as wide as the sound emitted from the origin is described with reference to FIGS. 6 to 12 below.

Figure 6A:
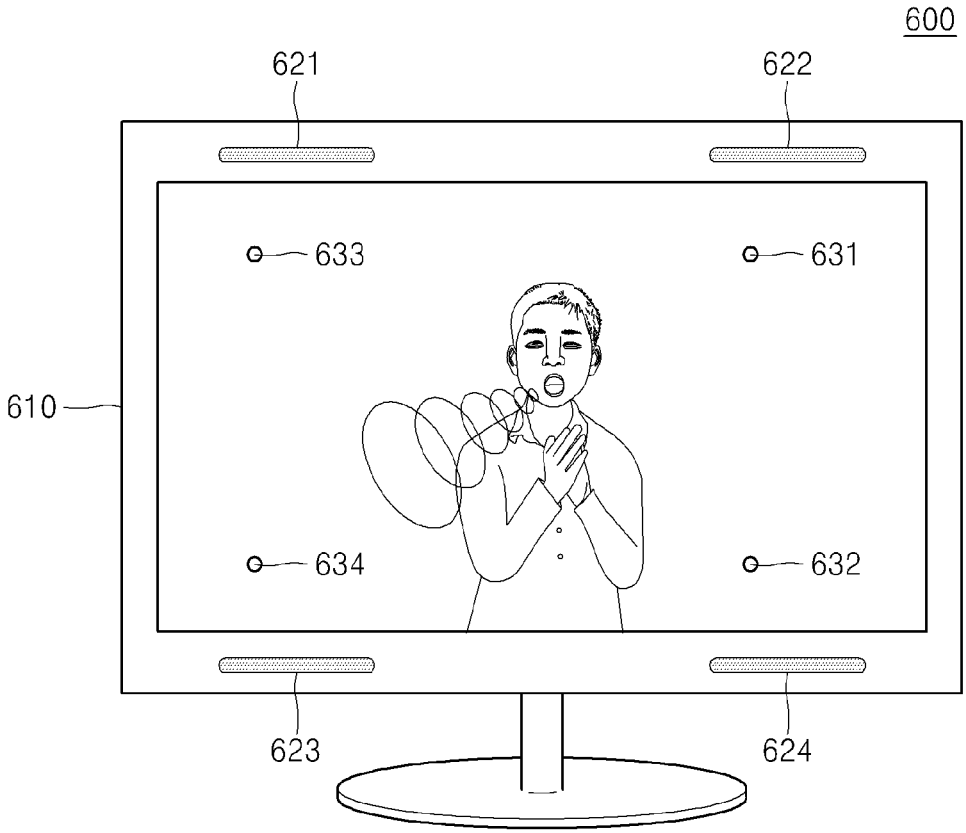
FIGS. 6A-6C, 7, and 11 are diagrams illustrating examples of a terminal apparatus including speakers according to exemplary embodiments.
Figure 6B:
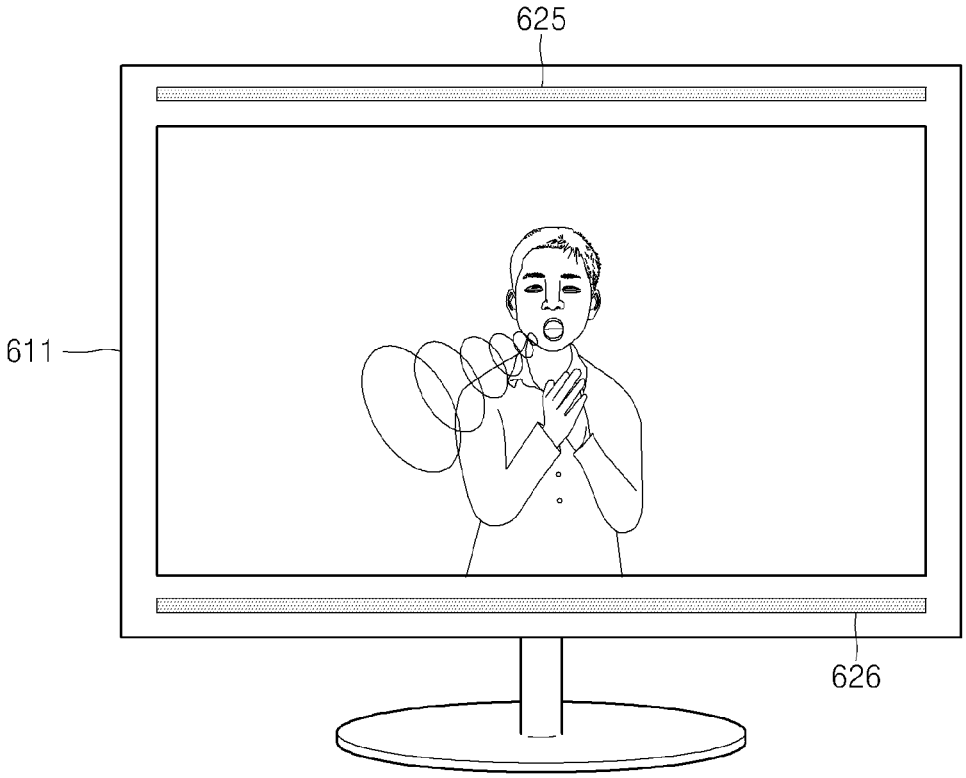
Figure 6C:
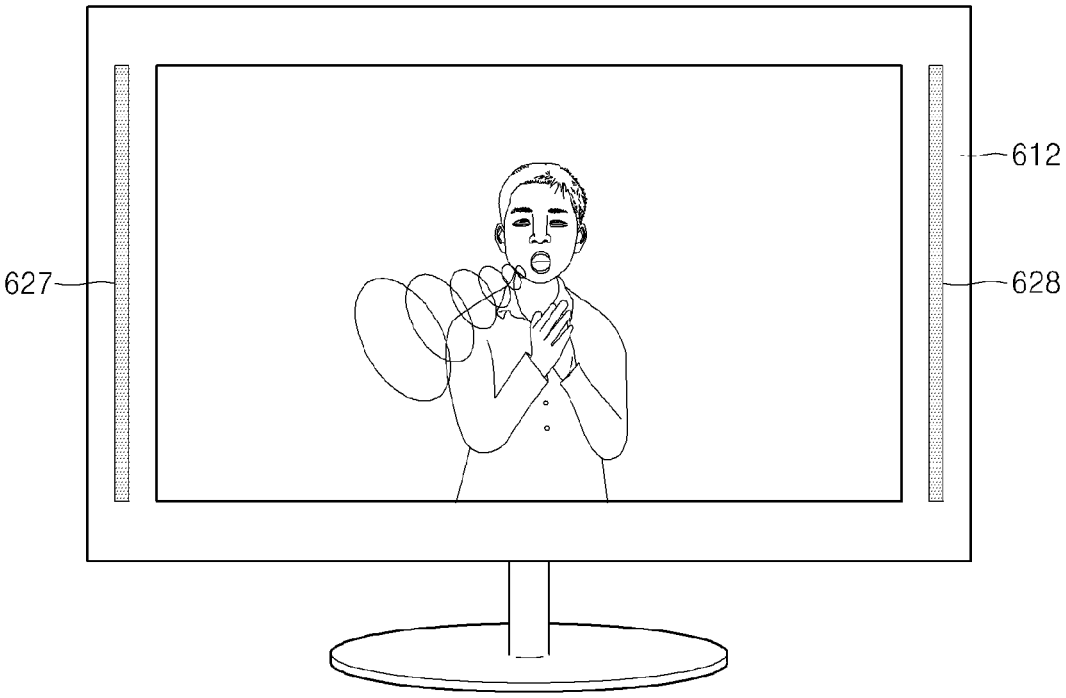
Figure 7:
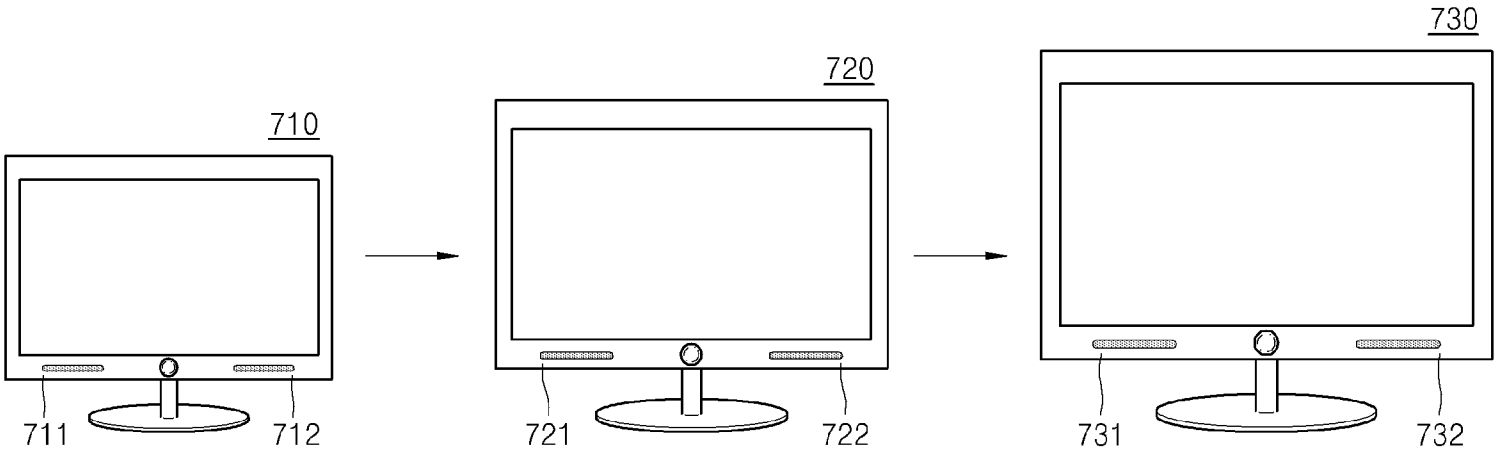

FIGS. 6 and 7 are diagrams illustrating examples of a terminal apparatus including a speaker according to exemplary embodiments.

Referring to FIG. 6A, terminal apparatus 600 includes speakers 621 to 624, a display 610, flat panel speakers 631 to 634, and a controller (not shown).

The speakers 621 to 624 may output a sound signal corresponding to an image that is displayed on the display 610 based on the control of the controller.

If the display 610 is large in size such as an ultra-high definition (UHD) display, when the speakers are located only on a lower end of the terminal apparatus 600, a listener may hear sound only via the speakers on the lower end and may not sense stereoscopic three-dimensional (3D) sound. Therefore, sound generated at an upper region of an image displayed on the display 610 may be output via speakers at an upper end of the terminal apparatus 600 to cause the listener to experience a stereoscopic effect caused when the sound is generated at the upper region of the image.

Thus, according to an exemplary embodiment, sound may be output through the speakers 621 to 624 at different locations according to a location of the sound on the image that is being displayed on the display 610 to give the stereoscopic effect to the listener. For example, the sound may be output from the terminal apparatus 600 in a direction that corresponds to a speaker or other audible device that is displayed on a screen of the terminal apparatus 600.

For example, the speaker 621 may output sound generated at a left upper region of the display 610 and the speaker 622 may output sound generated at a right upper region of the display 610. Also, in this example the speaker 623 may output sound generated at a left lower region of the display 610 and the speaker 624 may output sound generated at a right lower region of the display 610.

Also, the upper speakers 621 and 622 which may output high-frequency sound of high directivity from among sound generated at the upper region of the display 610. The lower speakers 623 and 624 may output low-frequency sound of low directivity from among the sound generated at the upper region of the display 610 or the sound generated at the lower end of the display 610.

Furthermore, in this example the terminal apparatus 600 includes the flat panel speakers 631 to 634 to provide a higher stereoscopic effect to a listener. The flat panel speakers 631 to 634 illustrated in FIG. 6A are examples of the vibration unit of the flat panel speaker described above.

The flat panel speakers 631 to 634 may output sound by generating a bending wave in a region of the screen where the sound is generated. This can address a problem in which sound generated at a central region of the display 610 is output from a region that is far from the central region. For example, when the display 610 is a UHD display, the size of the display 610 is large and sound is highly likely to be output from a region that is far from a region where the sound is generated on a screen. Thus, a listener would experience a separation due to the sound output being at a different position than the displayed image. For example, high-frequency sound has high directivity and thus the separation that the listener experiences may increase.

For example, referring to FIG. 6A, if a voice is heard from the mouth of a person included in an image, a listener would more naturally feel a stereoscopic effect when the voice is output at a position of the mouth of the person displayed on the display 610. The larger the size of the display 610, the more naturally the listener would feel the stereoscopic effect. To this end, according to an exemplary embodiment, the terminal apparatus 600 may control a voice from being output from the mouth of the person displayed on the display unit 600 using the flat panel speakers 631 to 634. For example, the terminal apparatus 600 may control high-directivity sound such as high-frequency sound to be output through the flat panel speakers 631 to 634.

Referring to FIG. 6A, the speakers 621 to 624 are included in the terminal apparatus 600. However, exemplary embodiments are not limited thereto. Also the speakers 621 to 624 may each include a clamping unit (not shown) and may be combined with the upper or lower end of the terminal apparatus 600 via the clamping unit.

Referring to FIG. 6B, terminal apparatus 600 in this example includes speakers 625 and 626 located along a top and a bottom of a display 611, and a controller (not shown). Referring to FIG. 6C, terminal apparatus 600 includes speakers 627 and 628 located along a left side and a right side of a display 612, and a controller (not shown).

Each of the speakers 625 to 628 illustrated in FIGS. 6B and 6C may be located vertically or horizontally with respect to the upper and lower ends of the left and right sides of the terminal apparatus 600.

The speakers 625 and 626 of FIG. 6B are located along a horizontal direction with respect to the upper and lower ends of the terminal apparatus 600 and have a length corresponding thereto. The speaker 625 located at the upper end of the terminal apparatus 600 may form an upper layer and output sound generated at an upper end of the display 611. Furthermore, the left and right portions of the speaker 625 at the upper end of the terminal apparatus 600 may output sound that is generated at a left upper region of the display 611 and sound generated at a right upper region of the display 611, respectively.

The speaker 626 located at the lower region of the terminal apparatus 600 may form a lower layer and output sound generated at the lower region of the display 611. Furthermore, left and right portions of the speaker 629 located at the lower region of the terminal apparatus 600 may output sound generated at a left lower region of the display 611 and sound generated at a right lower region of the display 611, respectively.

The speakers 627 and 628 of FIG. 6C are located along a vertical direction with respect to the upper and lower portions of the terminal apparatus 600. The speaker 627 located at the left side of the terminal apparatus 600 may output sound that is generated at a left region of the display 611. Furthermore, upper and lower portions of the speaker 627 of the terminal apparatus 600 may form an upper layer and a lower layer and may output sound generated at a left upper region of the display 611 and sound generated at a left lower region of the display 611, respectively.

The speaker 628 located at the right side of the terminal apparatus 600 may output sound generated at a right region of the display 611. Furthermore, upper and lower portions of the speaker 628 of the terminal apparatus 600 may form an upper layer and a lower layer and may output sound generated at a right upper region of the display 611 and sound generated at a right lower region of the display 611, respectively.

In the examples of FIGS. 6A-6C, speakers may be attached to the upper and lower ends of and/or the left and right sides of the display 610, 611, or 612 according to the size of the display to output sound.

For example, a 46-inch display which is relatively small in size may include speakers attached to the upper and lower regions of the display in a horizontal direction based on the distance between the left and right sides of the display being small. The speakers may output sound generated at the upper end of the display and sound generated at the lower end of the display, respectively. As another example, a 60-inch display which is relatively large in size may include speakers attached to the left and right sides of the display in a vertical direction based on the distance between the left and right sides of the display being large. The speakers may output sound generated at the left side of the display and sound generated at the right side of the display, respectively.

The speakers attached to the display may set a region of the display for outputting sound, for example, based on sensing performed by a gyrosensor or by determining whether the speakers are horizontally or vertically installed. For example, when the speakers are attached to the upper and lower regions of the display in the horizontal direction, the speakers may output sound generated at the upper region of the display and sound generated at the lower region of the display, respectively. Also, when the speakers are attached to the left and right regions of the display in the vertical direction, the speakers may output sound generated at the left side of the display and sound generated at the right side of the display, respectively.

In addition, the speakers may be attached to left and right sides of a curved display in the vertical direction, respectively, as illustrated in FIG. 6C. In this example, the speakers may output sound generated at the left side of the display and sound generated at the right side of the display, respectively.

According to an exemplary embodiment, speakers may be attached at locations on a display based on the size or shape of the display such that sound generated at various regions of the display may be output according to the locations of the speakers.

Referring to FIG. 7, terminal apparatus 710 includes speakers 711 and 712 at a lower end thereof, terminal apparatus 720 includes speakers 721 and 722 at a lower end thereof, and terminal apparatus 730 includes speakers 731 and 732 at a lower end thereof.

In these examples, one speaker is installed at each of a left side and a right side of each of the terminal apparatuses 710 to 730 to output sound in the left and right directions. The greater the distance between the left and right sides of the display, the greater the enhancement of the stereoscopic and imaging effects of sound output from the speakers.

Thus, according to exemplary embodiments, the speakers may be arranged on the left and right sides of the terminal apparatuses 710 to 730 such that the distance between the speaker on the left side and the speaker on the right side are maximized or otherwise increased according to the size of each of the terminal apparatuses 710 to 730. That is, when the speakers are included on an outer portion of the terminal apparatuses 710 to 730 and not within, the speakers may be arranged such that the distances between the speakers are maximized according to the sizes of the terminal apparatuses 710 to 730, thereby maximizing the stereoscopic and imaging effects of output sound. For example, the speakers may be arranged such that they are along a bottom pane of the terminal apparatus with a distance between them based on the width of the pane.

Although FIG. 7 illustrates only the speakers on the lower sides of the terminal apparatuses 710 to 730, the speakers may also or instead be arranged on the upper side of the display such as the display 610 illustrated in FIG. 6A such that the distance between the speakers 621 and 622 is maximized.

Also, as illustrated in FIG. 7, the speakers 711 to 732 are included in the terminal apparatuses 710 to 730. However, exemplary embodiments are not limited thereto and each of the speakers 711 to 732 may include a clamping unit and be combined with an upper or lower end of one of the terminal apparatuses 710 to 730 by the clamping unit.

FIGS. 8 to 10 and 12 are diagrams illustrating examples of a speaker apparatus according to exemplary embodiments.

Figure 8A:
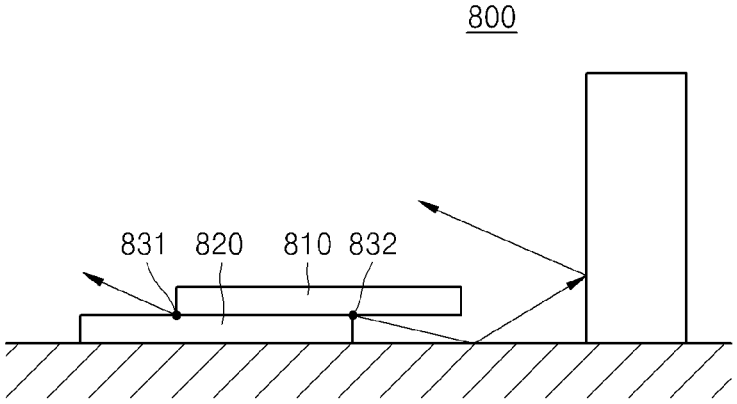
FIGS. 8A through 10B and 12 are diagrams illustrating examples of a speaker apparatus according to exemplary embodiments.
Figure 8B:
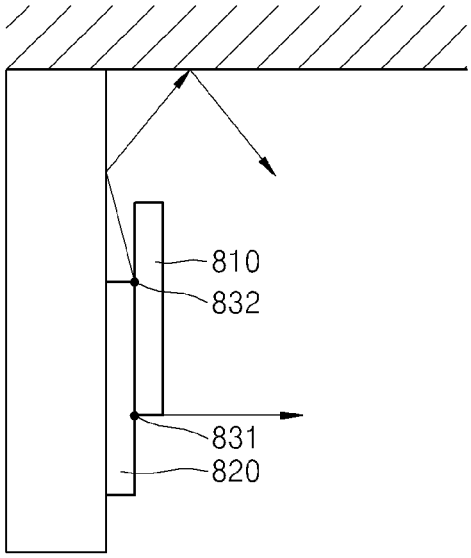

Apparatus 800 illustrated in FIG. 8A or 8B may be a speaker apparatus or a terminal apparatus including speakers. FIG. 8A illustrates an example in which the apparatus 800 is disposed on a horizontal plane. FIG. 8B illustrates an example in which the apparatus 800 is disposed on a wall surface perpendicular to a horizontal plane.

Referring to FIGS. 8A and 8B, the apparatus 800 includes slidable plates 810 and 820, and slits 831 and 832 of the slidable plates 810 and 820 include speakers outputting sound via the slits 831 and 832 (hereinafter, referred to as the speakers 831 and 832).

Referring to FIG. 8A, the apparatus 800 may obtain forward sound and/or backward sound by analyzing sound that is to be output or based on information about the sound. Also, the apparatus 800 may output the forward sound through the speaker 831 which in this example is a front speaker, and output the backward sound through the speaker 832 which in this example is a rear speaker.

The apparatus 800 may output high-frequency sound of high directivity through the speaker 832 and low-frequency sound of low directivity through the speaker 831 from among the backward sound. The backward sound is reflected from a rear wall surface of the apparatus 800 and then directed to a listener. Thus, the listener may experience the stereoscopic and imaging effects.

Referring to FIG. 8B, the apparatus 800 may obtain high-pitched sound by analyzing sound that is to be output or based on information about the sound. Also, the apparatus 800 may output high-pitched sound through the speaker 832 which in this example is an upper speaker and other sound through the speaker 831 which is a lower speaker.

The apparatus 800 may output high-frequency sound of high directivity through the speaker 832 which is an upper speaker and low-frequency sound of low directivity through the speaker 831 which is a lower speaker from among the high-pitched sound. Also, the high-pitched sound may be reflected from the surface of a ceiling disposed above the apparatus 800 and then directed to a listener. Thus, the listener may experience the stereoscopic and imaging effects.

Figure 9A:
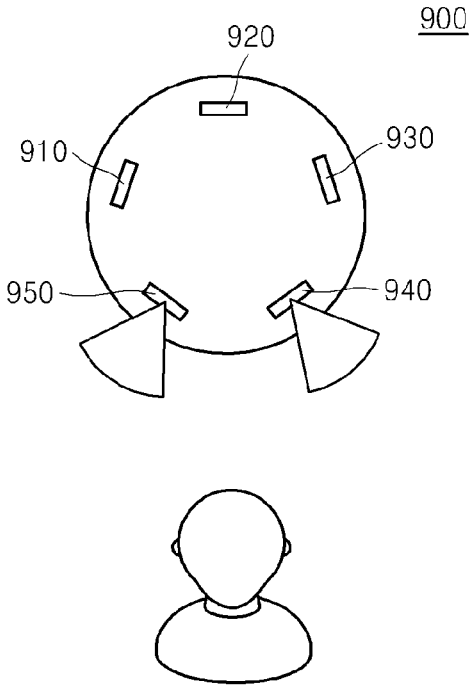

Referring to FIG. 9A, speaker apparatus 900 includes speaker modules 910 through 950.

The speaker apparatus 900 may detect a position of a listener using an infrared sensor or the like. In this example, the speaker apparatus 900 may select at least one of the speaker modules 950 and 940 for outputting sound via slits because these speakers are most adjacent to the position of the listener among the speaker modules 910 to 950. Also, the speaker apparatus 900 may output sound through at least one of the selected speaker modules so that the position of the listener is included in a sweet spot of the output sound.

Figure 9B:
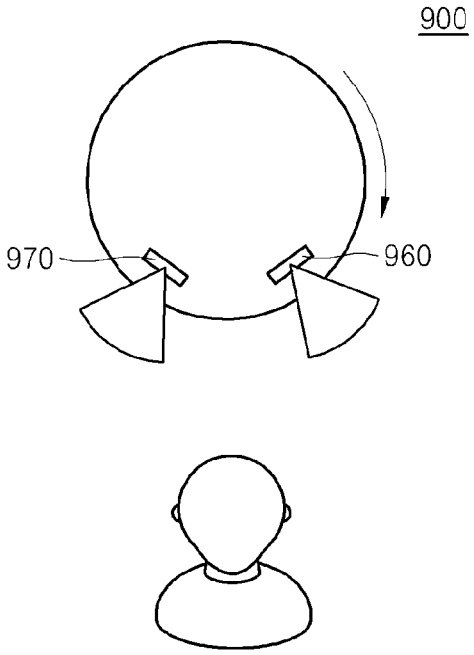

Referring to FIG. 9B, speaker apparatus 900 includes speaker modules 960 and 970.

The speaker apparatus 900 may detect the position of a listener using an infrared sensor or the like, and rotate the speaker modules 960 and 970 such that the position of the listener is included in a sweet spot of the output sound.

Although in the speaker apparatuses 900 illustrated in FIGS. 9A and 9B, sound is output through two speaker modules, exemplary embodiments are not limited thereto and it should be appreciated that sound may be output through more than two speaker modules according to the number of channels of a sound signal.

Figure 10A:
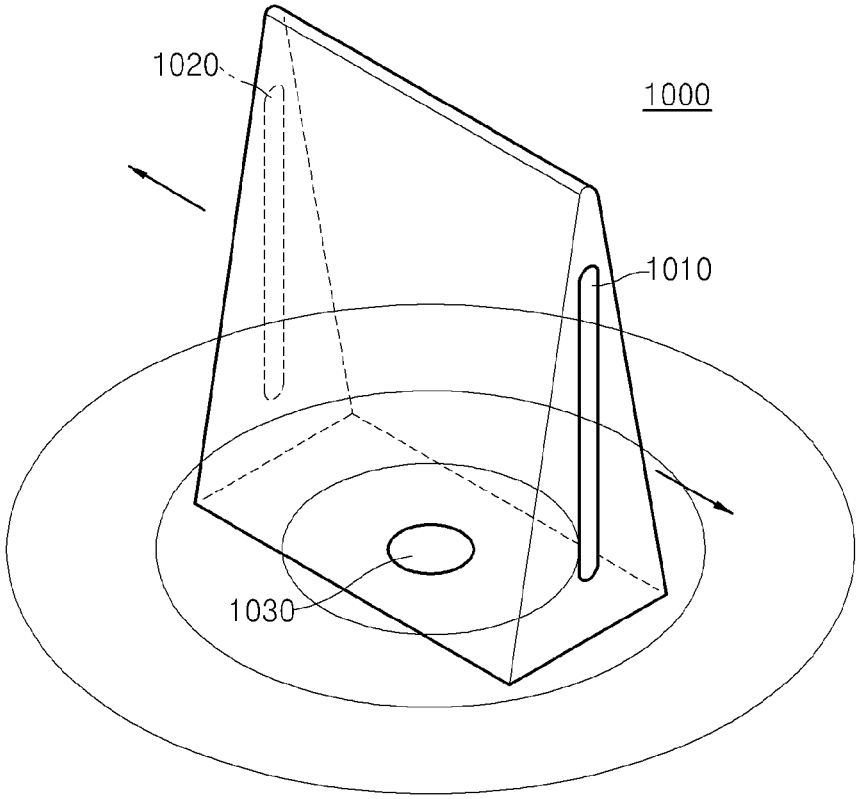
Figure 10B:
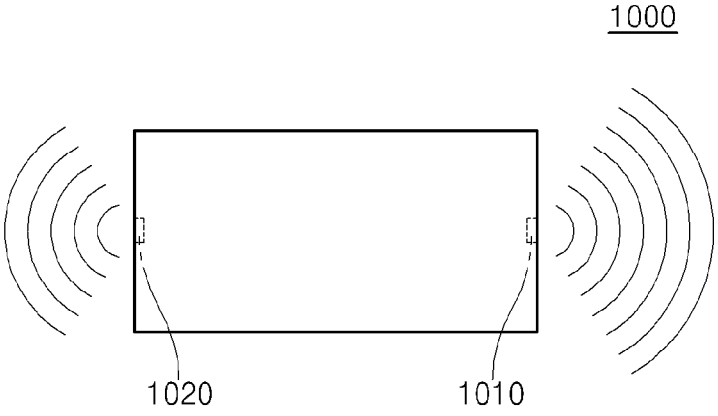

Referring to FIGS. 10A and 10B, speaker apparatus 1000 includes speakers 1010 and 1020, and a woofer 1030.

The speakers 1010 and 1020 may output middle-pitched sound and high-pitched sound. In this example, the speakers 1010 and 1020 are disposed on opposite sides of each other and output sound of different channels. Although FIGS. 10A and 10B illustrate only two speakers 1010 and 1020, exemplary embodiments are not limited thereto and it should be appreciated that the speaker apparatus 1000 may include more than two speakers.

The woofer 1030 may be a low-pitched sound speaker designed to output low-pitched sound, for example, sound of about 3 kHz or less. The woofer 1030 may be installed such that a sound vibration plate thereof faces downward and may output low-frequency sound via low slits in the speaker apparatus 1000 similar to a speaker.

FIG. 10B is a view from above the speaker apparatus 1000 of FIG. 10A. The speakers 1010 and 1020 may output sound bilaterally. The speakers 1010 and 1020 may generate a sweet spot in a forward direction of the display to be as wide as the sound emitted from the origin. Thus, when the speakers 1010 and 1020 output sound in opposite directions as illustrated in FIGS. 10A and 10B, a sweet spot may be formed in wide forward and backward regions of the speaker apparatus 1000.

Therefore, even when high-directivity sound is output through the speakers 1010 and 1020, a sweet spot of the sound may be formed as wide as the sound emitted from the origin according to the features of the speakers 1010 and 1020. That is, according to an exemplary embodiment, high-frequency sound of high directivity may be output through the speakers 1010 and 1020 which are the upper speakers and low-frequency sound of low directivity may be output through the woofer 1030 which is the lower speaker.

As another example, the speaker apparatus 1000 may further include a flat panel speaker (not shown) on a front or a back surface thereof to output middle-pitched sound and high-pitched sound.

Figure 11:
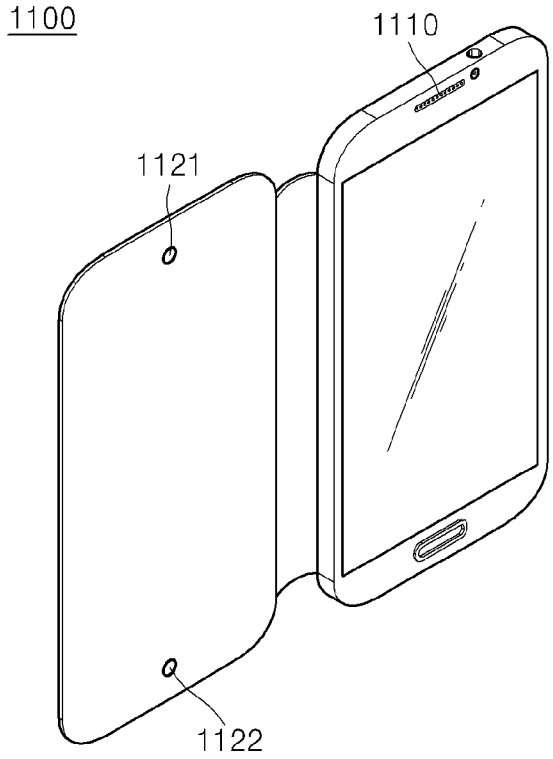

FIG. 11 is a diagram illustrating an example of a terminal apparatus including a speaker according to an exemplary embodiment.

Referring to FIG. 11, terminal apparatus 1100 includes a speaker 1110, and flat panel speakers 1121 and 1122 which in this example are disposed in a flip cover.

The flat panel speakers 1121 and 1122 may generate a vibration that outputs a haptic effect when a page is flipped over on a display by a user manipulating a document displayed on the terminal apparatus 1100 or when a soft button displayed on the display is input by the user. Also, the terminal apparatus 1100 may output sound through not only the speaker 1110 but also through the flat panel speakers 1121 and 1122 in the flip cover, thereby enhancing a stereoscopic imaging effect of a sound source. Accordingly, sound may be output through speakers of various regions of the terminal apparatus 1100, thereby enhancing the stereoscopic imaging effect of the sound source.

In the example of FIG. 11, low-frequency sound may be output through the speaker 1110.

Figure 12:
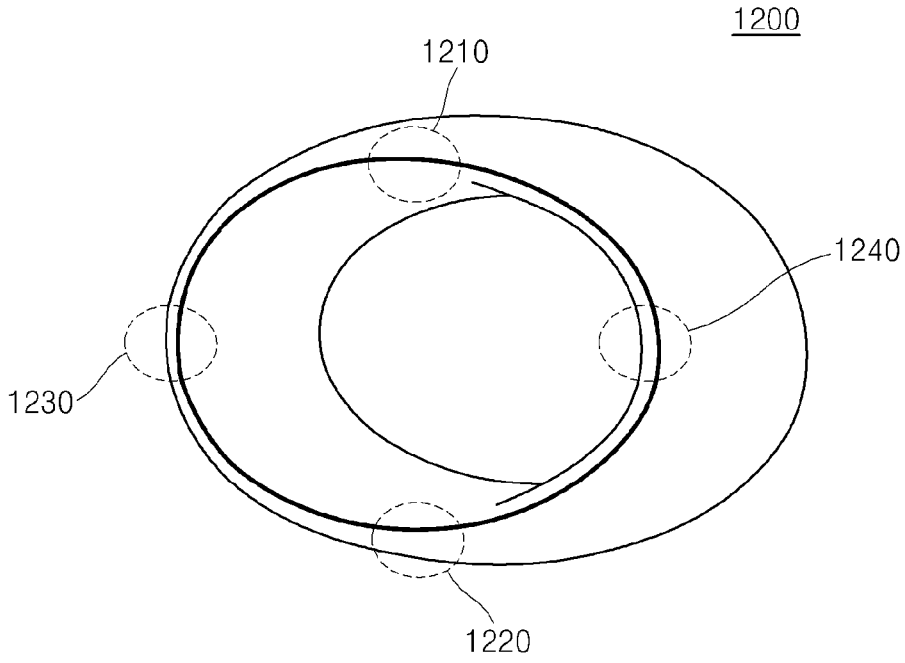

FIG. 12 is a diagram illustrating an example of a speaker apparatus according to exemplary embodiment.

Referring to FIG. 12, speaker apparatus 1200 may have an oval or circular shape and in this example includes speaker modules 1210 to 1240. The speaker modules 1210 to 1240 may output sound via round slits indicated by a thick line in FIG. 12.

The speaker modules 1210 to 1240 located on a front surface of the speaker apparatus 1200 may output sound of a front-surface sound source, and speaker modules that are not shown in this example located on a rear surface of the speaker apparatus 2000 may output sound of a rear-surface sound source.

In this example, middle-pitched sound and high-pitched sound that have high directivity may be output through the speakers 1230 and 1240 according to channels thereof, respectively. Low-pitched sound that has low directivity may be output through the speakers 1210 and 1220 which are upper and lower speakers. High-directivity sound may be output through the speaker 1230 or 1240 according to a direction thereof. For example, high-directivity sound that has a left directional property may be output through the speaker 1230 which is a left speaker. In contrast, low-pitched sound of low directivity may be output through the speakers 1210 and 1220 which are upper and lower speakers without determining whether the sound has a left or a right directional property.

An additional structure such as a light emitting diode (LED) bulb may be further disposed on a center of the speaker apparatus 1200 to add an additional function to the speaker apparatus 1200. For example, the LED bulb may be turned on when sound is output from the speaker apparatus 1200.

A method of outputting sound through a speaker apparatus such as that of the apparatus 800 shown in FIG. 8 is described with reference to FIG. 13 below.

Figure 13:
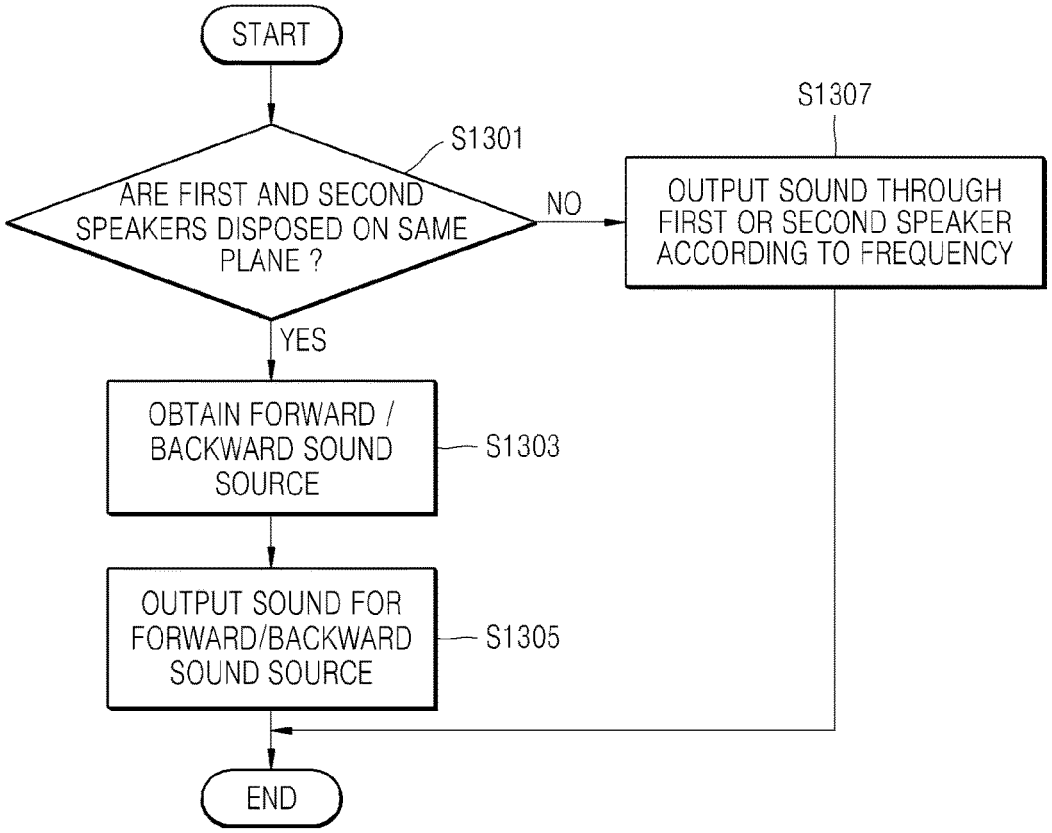
FIG. 13 is a flowchart illustrating a method of outputting sound via a speaker apparatus according to an exemplary embodiment.

FIG. 13 is a flowchart illustrating a method of outputting sound via a speaker apparatus according to an exemplary embodiment.

Referring to FIG. 13, in operation S1301, the speaker apparatus determines whether a first speaker and a second speaker that output sound via at least one slit are disposed on a same plane.

If the first speaker and the second speaker are disposed on the same plane, for example, that the speaker apparatus is disposed on a bottom surface as illustrated in FIG. 8A, the speaker apparatus performs operation S1303. In operation S1303, the speaker apparatus 800 obtains a forward/backward sound source from a sound signal to be output. In this case, the forward/backward sound source is a sound signal to be output similar to a sound source generated at a front or rear surface of the speaker apparatus.

In operation S1305, the speaker apparatus may output sound for the forward/backward sound source, which is obtained in operation S1303, through the first speaker and the second speaker.

For example, the speaker apparatus may output high-frequency sound of high directivity through a rear speaker and low-frequency sound of low directivity through a front speaker from among backward sound. The backward sound may be reflected from a rear wall surface of the speaker apparatus and directed to a listener. Accordingly, the listener may experience the stereoscopic and imaging effects.

Also, when it is determined that the first speaker and the second speaker are disposed on different horizontal planes, for example, that the speaker apparatus is disposed on a wall surface as illustrated in FIG. 8B, the speaker apparatus may perform operation S1307. In operation S1307, the speaker apparatus obtains high-pitched sound from a sound signal to be output, and control high-frequency sound from among the high-pitched sound through the speaker which is the upper speaker. Also, the speaker apparatus may control low-frequency sound from among the high-pitched sound or other sound except for the high-pitched sound to be output through the speaker which is the lower speaker.

As described above, according to exemplary embodiments, a high-pitched sound signal may be output on an upper layer of a display through a speaker to form a wide sweet spot.

According to exemplary embodiments, 3D sound representing high-pitched sound or a forward/backward sound source may be output through a plurality of speakers.

A method according to an exemplary embodiment of the present invention can be embodied as computer readable code in a non-transitory computer readable recording media (including various devices having an information processing function). The non-transitory computer readable recording media include various types of recording apparatuses capable of storing data that is read by a computer system, e.g., read-only memory (ROM), random access memory (RAM), a compact disc (CD)-ROM, a magnetic tape, a floppy disk, an optical data storage device, and the like.

Although various exemplary embodiments have been described, it would be obvious to those of ordinary skill in the art that the above exemplary embodiments are to cover all modifications, equivalents, and alternatives falling within the scope of the inventive concept. Accordingly, it will be understood that various changes in form and details may be made therein without departing from the spirit and scope of the following claims.

What is claimed is:

1. A speaker apparatus comprising:

a first speaker configured to output a first sound of a sound signal via a first slit;

a second speaker configured to output a second sound of the sound signal via a second slit; and a controller configured to control the first speaker and the second speaker, wherein the controller determines whether the speaker apparatus is disposed on a vertical plane, obtains a first signal of a first sound including an elevation effect from the sound signal and a second signal of a second sound including low directivity from the sound signal, and controls the first speaker to output the first sound via the first slit and controls the second speaker to output the second sound via the second slit if it is determined that the speaker apparatus is disposed on the vertical plane, wherein the speaker apparatus further comprises at least two slidable plates, and the first slit from among slits between the at least two slidable plates is located in one direction of the speaker apparatus and the second slit from among the slits between the at least two slidable plates is located in an opposite direction from the first slit.

2. The speaker apparatus of claim 1, wherein each slit of the first and second slits has a thickness that is less than a wavelength of sound to be emitted.

3. The speaker apparatus of claim 1, wherein the first speaker and the second speaker are further configured to output sound of different channels, respectively, according to each location of the first and second speakers.

4. The speaker apparatus of claim 1, further comprising a sensor configured to sense a position of a user, wherein the first and second speakers are configured to output sound by being moved according to the sensed position of the user, or the apparatus is configured to output sound via a slit that is adjacent to the sensed position of the user.

5. The speaker apparatus of claim 1, further comprising a display for displaying an image, wherein the first and second speakers are configured to output sound related to the displayed image.

6. The speaker apparatus of claim 5, further comprising a flat panel speaker configured to output sound at a location on the image displayed on the display at which the sound is generated using bending waves.

7. The speaker apparatus of claim 6, wherein the flat panel speaker is configured to output a haptic effect using the bending waves.

8. The speaker apparatus of claim 1, further comprising a sensor configured to sense a position of the speaker apparatus, wherein the controller determines whether the speaker apparatus is disposed on the vertical plane, based on the sensed position of the speaker apparatus.

9. The speaker apparatus of claim 1, further comprising at least two slidable plates, and wherein the first slit from among slits between the at least two slidable plates is located in an upper portion of the speaker apparatus and the second slit from among slits between the at least two slidable plates is located in a lower portion of the speaker apparatus.

10. The speaker apparatus of claim 1, wherein an outputting sound via the first slit is reflected from a surface of a ceiling above the speaker apparatus.

11. The speaker apparatus of claim 1, wherein an outputting sound via the second slit includes a low-frequency sound of the first sound.

12. A method of outputting sound by a speaker apparatus including a first speaker and a second speaker, the method comprising:

determining whether the speaker apparatus is disposed on a vertical plane, the first speaker being configured to output a first sound of a sound signal via a first slit and the second speaker being configured to output a second sound of the sound signal via a second slit;

obtaining a first signal of a first sound including an elevation effect from the sound signal and a second signal of a second sound including low directivity from the sound signal to be output; and outputting the first sound by the first speaker via the first slit and the second sound by the second speaker via the second slit in response to determining that the speaker apparatus is disposed on the vertical plane, wherein the speaker apparatus further comprises at least two slidable plates, and the first slit from among slits between the at least two slidable plates is located in one direction of the speaker apparatus and the second slit from among the slits between the at least two slidable plates is located in an opposite direction from the first slit.

13. A non-transitory computer readable medium having recorded thereon a computer program that is executable by a computer to perform the method of outputting sound of claim 12.

14. The method of claim 12, wherein the determining comprises:

sensing a position of the speaker apparatus; and determining whether the speaker apparatus is disposed on the vertical plane, based on the sensed position of the speaker apparatus.

15. The method of claim 12, wherein the speaker apparatus comprises at least two slidable plates, and the first slit from among slits between the at least two slidable plates is located in an upper portion of the speaker apparatus and the second slit from among slits between the at least two slidable plates is located in a lower portion of the speaker apparatus.

16. The method of claim 12, wherein an outputting sound via the first slit is reflected from a surface of a ceiling above the speaker apparatus.

17. The method of claim 12, wherein an outputting sound via the second slit includes a low-frequency sound of the first sound.

* * * * *